US010399134B2

(12) United States Patent
Fan et al.

(10) Patent No.: US 10,399,134 B2
(45) Date of Patent: Sep. 3, 2019

(54) METAL PLATE AND METAL COVER EMPLOYING SAME

(71) Applicants: NISSAN MOTOR CO., LTD., Yokohama-shi, Kanagawa (JP); NICHIAS Corporation, Tokyo (JP); APJ Corporation, Yamato-shi, Kanagawa (JP)

(72) Inventors: Xu Fan, Kanagawa (JP); Atsushi Misaki, Yamato (JP)

(73) Assignees: NISSAN MOTOR CO., LTD., Yokohama-shi, Kanagawa (JP); NICHIAS CORPORATION, Tokyo (JP); APJ CORPORATION, Yamato-shi, Kanagawa (JP)

( * ) Notice: Subject to any disclaimer, the term of this patent is extended or adjusted under 35 U.S.C. 154(b) by 0 days.

(21) Appl. No.: 15/748,785

(22) PCT Filed: May 24, 2016

(86) PCT No.: PCT/JP2016/065234

§ 371 (c)(1),
(2) Date: Jan. 30, 2018

(87) PCT Pub. No.: WO2017/022301

PCT Pub. Date: Feb. 9, 2017

(65) Prior Publication Data

US 2019/0009320 A1 Jan. 10, 2019

(30) Foreign Application Priority Data

Jul. 31, 2015 (JP) ..... 2015-151387

(51) Int. Cl.
*B21D 13/02* (2006.01)
*B21D 13/04* (2006.01)
(Continued)

(52) U.S. Cl.
CPC ..... *B21D 13/02* (2013.01); *B21D 13/04* (2013.01); *F01N 13/14* (2013.01); *F01N 13/18* (2013.01);
(Continued)

(58) Field of Classification Search
CPC ..... B21D 13/04; B21D 13/14; B21D 13/02; F01N 13/14; F01N 2260/20; F01N 13/1811
(Continued)

(56) References Cited

U.S. PATENT DOCUMENTS 3,217,845 A 11/1965 Reynolds et al.
4,044,186 A 8/1977 Stangeland
(Continued)

FOREIGN PATENT DOCUMENTS

GB 177 780 A 2/1923
JP H04-220128 A 8/1992
(Continued)

*Primary Examiner* — Forrest M Phillips
(74) *Attorney, Agent, or Firm* — Drinker Biddle & Reath LLP

(57) ABSTRACT

Projection row (2) and recess row (3) are alternately and successively formed in a direction (Y-direction) perpendicular to a direction (X-direction) of their rows, thereby forming a corrugated cross-sectional shape of a cross-sectional wave shape. Between projection row (2) and recess row (3), there is provided inclined wall surface (4) having a wave shape in plan view. Each of projection row (2) and recess row (3) has a shape in a cross-section along X-direction that is formed into a corrugated cross-sectional shape of a wave shape. Pitch and height difference between valley portion (5) and crest portion (6) in the corrugated cross-sectional shape along this X-direction are smaller, as compared with a relationship between projection row (2) and recess row (3) in the corrugated cross-sectional shape along Y-direction. The corrugated metal plate of such shape has advantages
(Continued)

that machining for making cross-sectional shapes in two directions of X and Y into wave shapes is easy and that the flexural rigidity difference between two direction of X and Y is extremely small.

8 Claims, 15 Drawing Sheets

(51) Int. Cl.
*F01N 13/14* (2010.01)
*F01N 13/18* (2010.01)

(52) U.S. Cl.
CPC ..... *F01N 13/1811* (2013.01); *F01N 2260/20* (2013.01)

(58) Field of Classification Search
USPC ..... 181/292, 282
See application file for complete search history.

(56) References Cited

U.S. PATENT DOCUMENTS

| | | | | |
|---|---|---|---|---|
| 4,332,307 | A * | 6/1982 | Ito | F01N 1/24 181/256 |
| 5,594,218 | A * | 1/1997 | Diaz | E04B 1/84 181/292 |
| 8,251,175 | B1 * | 8/2012 | Englert | E04B 9/001 181/292 |
| 2006/0065480 | A1 * | 3/2006 | Leehaug | F01N 13/14 181/283 |
| 2018/0281040 | A1 * | 10/2018 | Abe | B21D 13/02 |

FOREIGN PATENT DOCUMENTS

| | | | |
|---|---|---|---|
| JP | H07-1045 | A | 1/1995 |
| JP | 2001-504393 | A | 4/2001 |
| JP | 2007-175759 | A | 7/2007 |
| JP | 2007-262927 | A | 10/2007 |
| JP | 2009-184001 | A | 8/2009 |
| JP | 5039233 | B1 * | 7/2012 |

* cited by examiner

METAL PLATE AND METAL COVER EMPLOYING SAME

TECHNICAL FIELD

The present invention relates to a so-called corrugated metal plate, in which both of cross-sectional shapes respectively along one particular direction and a direction intersecting the same are formed into a wave shape, and to a metal cover employing the metal plate. For example, it relates to a metal plate, which is suitably used as one that is arranged close to an automobile's heat generating section for the purpose of heat insulation, and to a metal cover employing the metal plate.

BACKGROUND ART

A corrugated metal plate is frequently used as a heat insulation cover (also referred to as a heat insulator, including one having a vibration-damping function and/or sound absorption function) that is arranged close to an exhaust manifold or exhaust pipe (muffler) as an automobile's heat generating section. A typical corrugated metal plate is proposed in Patent Publication 1.

The corrugated metal plate disclosed in Patent Publication 1 is one which is prepared by using a thin metal plate of aluminum or the like as a flat plate material and in which both of cross-sectional shapes respectively along two directions, that is, one particular direction (X-direction) and a direction (Y-direction) perpendicular thereto are formed into a wave shape by a repetition of an alternate arrangement of a projection portion and a recess portion.

One described in Patent Publication 1 has one characteristic that is high in elastic property by having in a particular cross-section a so-called bag-shape recess portions 23 (see FIG. 5 of Patent Publication 1) in which a bottom side of an inner portion has a width wider than that of an open side (mouth side).

As to the recess portion in which a bottom side of an inner portion has a width wider than that of an open side (mouth side) in a particular cross-section, from the viewpoint of press working property, it is nothing else but a condition in which the shape of the recess portion turns into a hooking relation by an undercut or inverse relation relative to a direction of withdrawal of a press tool (mold) that makes the recess portions.

In the corrugated metal plate described in Patent Publication 1, however, the wave shape by a roughness repetition to include the recess portions has a special shape. Therefore, it is necessary to conduct the press operation or bending operation several times by using a special pressing facility. Thus, it is forced to have an increased cost by an increase of the number of working operations. In addition, there exists a part where a bending operation has been conducted such that the plate members are locally overlapped in connection with an inverse shape of the recess portion. Therefore, in this part, stress concentration tends to occur, for example, in the case of receiving the vibration force repeatedly.

Furthermore, in the corrugated metal plate described in Patent Publication 1, since both of the cross-sectional shapes in the two directions are corrugated, it is possible to expect the surface rigidity improvement effect. However, the difference of rigidity against bending between X-direction and Y-direction tends to result in a significant strength difference. Furthermore, the shape is significantly different between the front side and the back side. Therefore, for example, in the case of forming into a predetermined three-dimensional shape as a heat insulation cover that is a product, the corrugated metal plate turns into a shape having directional property including a front-and-back relation. As a result, the corrugated metal plate is not superior in usability.

Furthermore, in case that, for example, the corrugated metal plate described in Patent Publication 1 is used as a base plate and then this is formed into a predetermined three-dimensional shape (product shape), for example, as a heat insulation cover that is arranged close to an exhaust manifold that is an automobile's heat generating section, by conducting a bending operation to have a pan shape (shallow pan shape or deep pan shape) or cup shape, the recess portion, in which bottom side of an inner portion has a width wider than that of an open side (mouth side) as mentioned above, may unexpectedly function as a liquid pool.

PRIOR ART PUBLICATIONS

Patent Publications

Patent Publication 1: Japanese Patent Application Publication 2007-262927

SUMMARY OF THE INVENTION

The present invention was made in view of the above-mentioned task. In particular, it provides a metal plate and a metal cover, in which a corrugation or embossing work for forming both of cross-sectional shapes into a wave shape is easy, and which are usable irrespective of directional property by minimizing the difference of flexural rigidity between the two directions.

The present invention is one in which its main metal plate has an upper surface, a side wall surface, a lower surface and a side wall surface in this order in succession to form a row having a shape of a projection and a recess, wherein each side wall surface is formed into a wave shape in plan view, and wherein the upper surface and the lower surface are respectively formed into wave shapes in their cross-sections along their rows' direction.

The metal plate of the present invention can be used not only as a heat insulation cover of an automobile's heat generating section, but also as a structural material in various industrial fields other than automobile, as mentioned hereinafter. It can be used in various uses other than heat insulation, such as sound insulation material, sound absorbing material, wind insulation material, light insulation material, etc.

According to the metal plate of the present invention, both of cross-sectional shapes along two directions, that is, their respective rows' direction of the row having a shape of a projection and a recess and a direction intersecting the same are in a corrugated shape. Therefore, not only it is high in second moment of area and is improved in surface rigidity, but also it is possible to minimize the difference of flexural rigidity in the two directions. For example, even in the case of producing a heat insulation cover or the like by forming into a predetermined three-dimensional product shape, the directional property does not matter, and the corrugated metal plate becomes superior in usability.

MODE FOR IMPLEMENTING THE INVENTION

Figure 1:
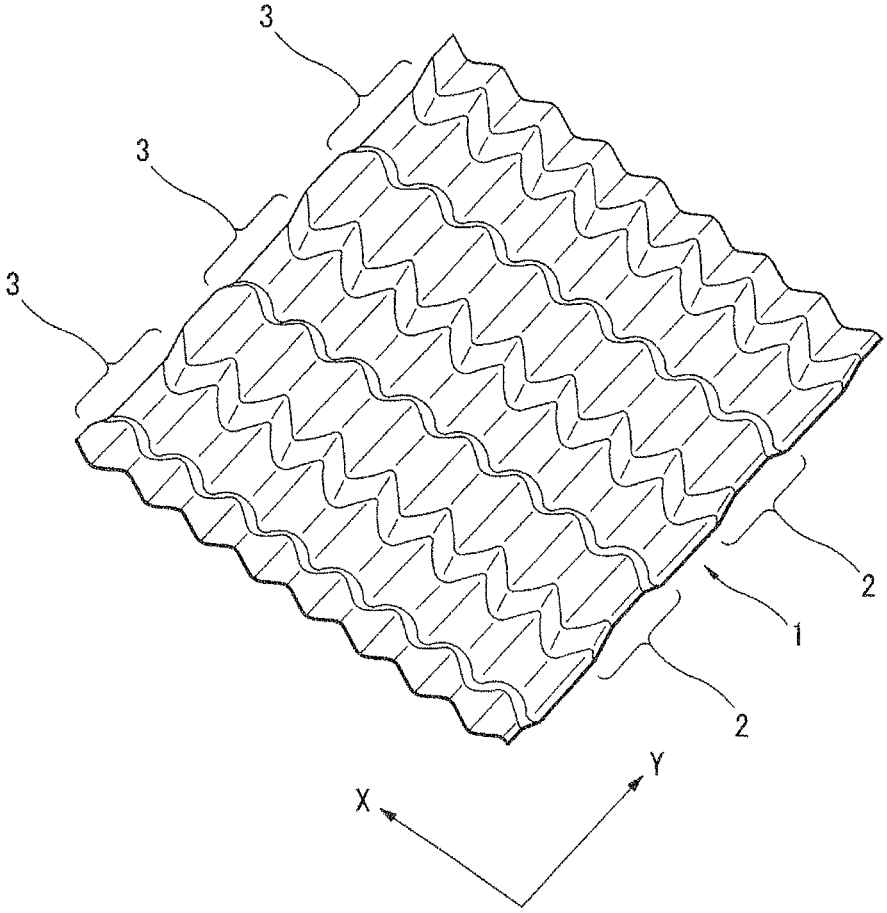
FIG. 1 is a perspective view from above, showing the first embodiment of a metal plate according to the present invention.
Figure 2:
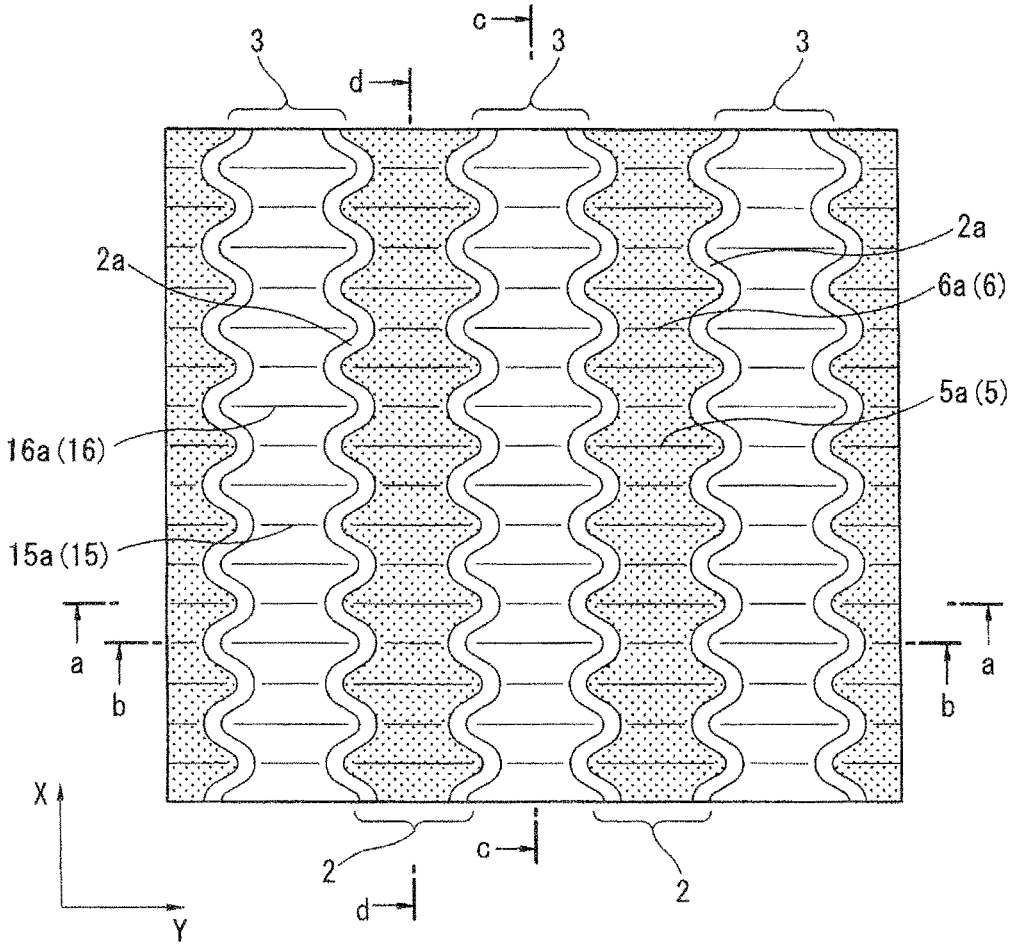
FIG. 2 is a plan view of the metal plate shown in FIG. 1.

FIGS. 1-6 show the first embodiment, which is more specific in order to implement the metal plate according to the present invention. In particular, FIG. 1 shows a perspective view from above of a corrugated metal plate, and FIG. 2 is a plan view of FIG. 1. FIGS. 3(A) and 3(B) respectively show sectional views taken along lines a-a and lines b-b of FIG. 2. FIGS. 4(A) and 4(B) respectively show sectional views taken along lines c-c and lines d-d of FIG. 2. Furthermore, for an easy understanding of the corrugated metal plate shown in FIGS. 1 to 4, photographs of the metal plate are shown in FIGS. 13-17.

In FIG. 2, for an easy understanding of a projection-recess relation between adjacent projection row 2 and recess row 3, only projection row 2 is shown halftone by adding gradation. Furthermore, corrugated metal plate 1 shown in FIG. 1 is formed by using, for example, an aluminum flat plate material having a plate thickness of about 0.6 mm as a base plate. The plate thickness is, however, not particularly limited, and the material of the flat plate material used as a base plate is not limited to aluminum, either. It is optional to use nonferrous metal plates other than aluminum one, metal plates represented by steel plate, and a composite material (cladding material) having two or three layers of a steel plate, a metal plate other than that, and a nonferrous metal.

Figure 3:
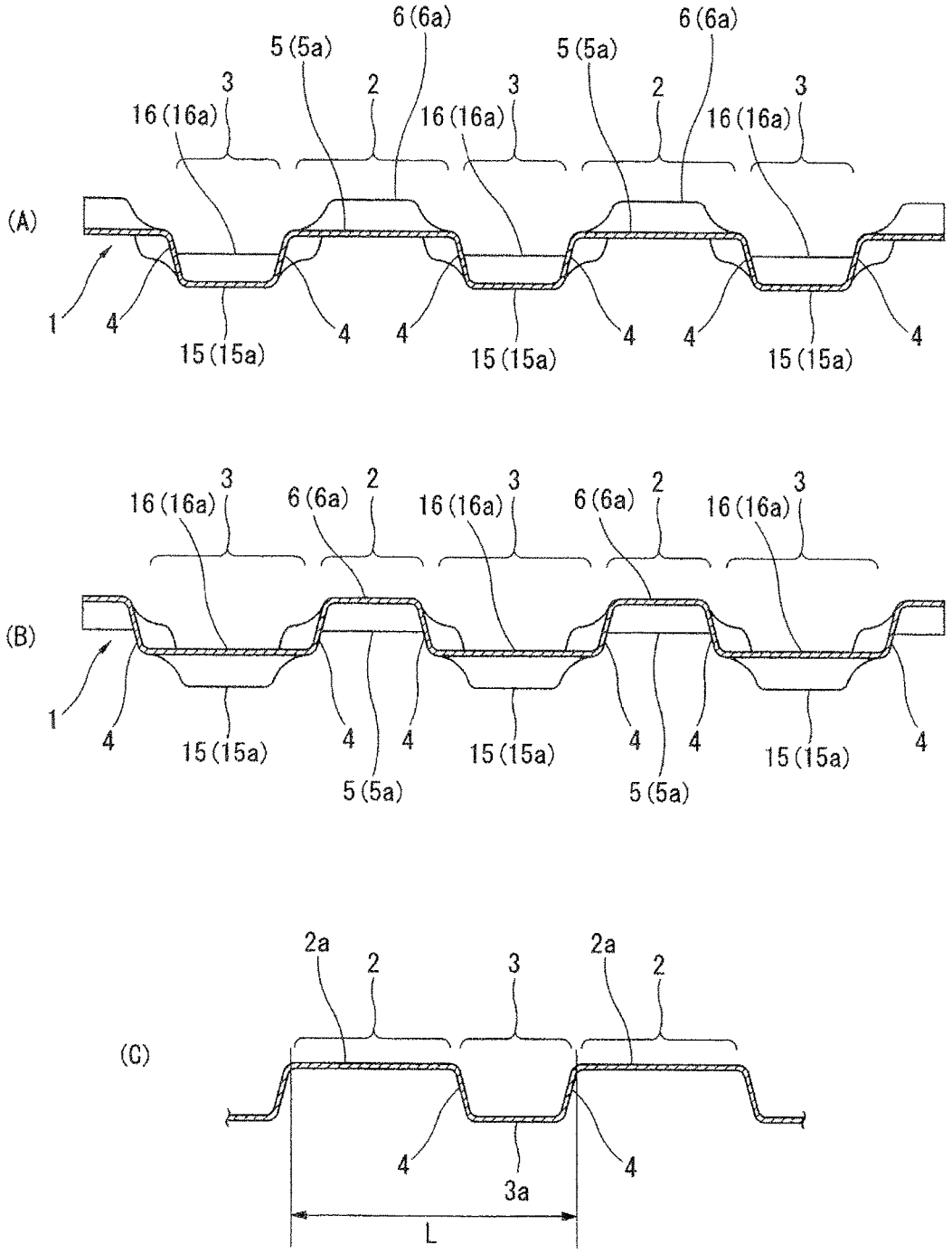
FIG. 3(A) is a sectional view taken along lines a-a of FIG. 2.
FIG. 3(B) is a sectional view taken along lines b-b of FIG. 2.

In case that one particular direction is defined as X-direction and that a direction perpendicular to this X-direction is defined as Y-direction, in the corrugated metal plate 1 shown in FIGS. 1 and 2, embossed projection rows 2 and inversely embossed or groove-shape recess rows 3, which respectively extend in X-direction, are formed by bending in a manner that they are alternately aligned in Y-direction to be in succession by a plural number of them, such that the shape of a cross-section along Y-direction is formed in a wave shape. As shown in FIG. 3, the shape of a cross-section along Y-direction is formed to have a so-called corrugated cross-sectional shape like a rectangular wave. Then, the projection row 2 and its adjacent recess row 3 share inclined wall surface 4 as the side wall surface, and inclined wall surface 4 serves at once as the side wall surfaces of both of adjacent projection row 2 and recess row 3. With this, recess row 3 having inclined wall surfaces 4 at its both sides is formed with an inversely trapezoidal groove space in which the groove width on the open side (mouth side) is greater than that on the bottom side.

That is, as shown in FIG. 3(C) prepared by enlarging a portion of FIG. 3(A), when seeing only a relation of projection row 2 and recess row 3, in a range of "L" of FIG. 3(C), upper surface 2*a* corresponding to the top surface of projection row 2, one inclined wall surface 4 forming recess row 3, lower surface 3*a* similarly forming the bottom surface of recess row 3, and the other inclined wall surface 4 similarly forming the recess row 3*a* are in succession in the order of top surface 2*a*, inclined wall surface 4, bottom surface 3*a* and inclined wall surface 4. These four surfaces as one unit element are formed by repetition in succession. Therefore, as shown in FIG. 3, projection rows 2 and recess rows 3 are alternately formed in succession.

Figure 5:
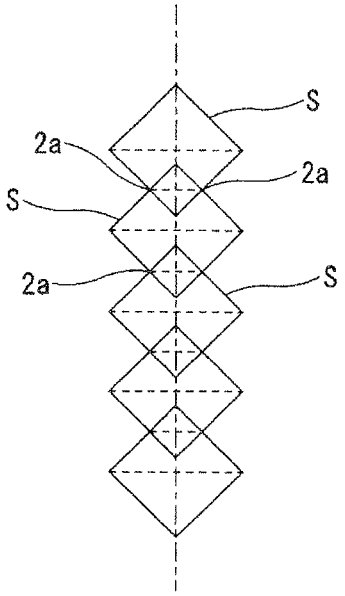
FIG. 5 is an explanatory view showing a concept of planer shape of a projection row and a recess row in FIG. 2.

As a plan view shape of projection row 2, as shown in FIG. 2, it has a shape in which flat hexagons with round corner portions are in succession with no gap therebetween in X-direction, and the minimum width portion between adjacent hexagons becomes narrow portion 2*a*. From another viewpoint, as shown in FIG. 5, as a plan view of projection row 2, it has a shape in which tetragon (including rhombus) S in plan view is defined as a unit element (cell) and in which a plurality of tetragons S, S are in succession while they are overlapped (superimposed) with each other by a predetermined amount at their respective corner portions in one diagonal line matching with X-direction. Then, an overlapped portion between the corner portions of adjacent tetragons S becomes narrow portion 2*a*. The plan view shape only explains a shape in plan view, and it may have a three-dimensional shape.

The plan view shape of this projection row 2 also appears even in recess row 3 adjacent to projection row 2. As shown in FIG. 2, projection row 2 and recess row 3 have a common plan view shape, but are adjacent to each other in a manner that hexagons (tetragons S of FIG. 5) as unit elements are displaced by a half pitch in the longitudinal direction and that corner portions along Y-direction and the narrow portions of hexagons as their respective unit elements fit with each other.

Figure 4:
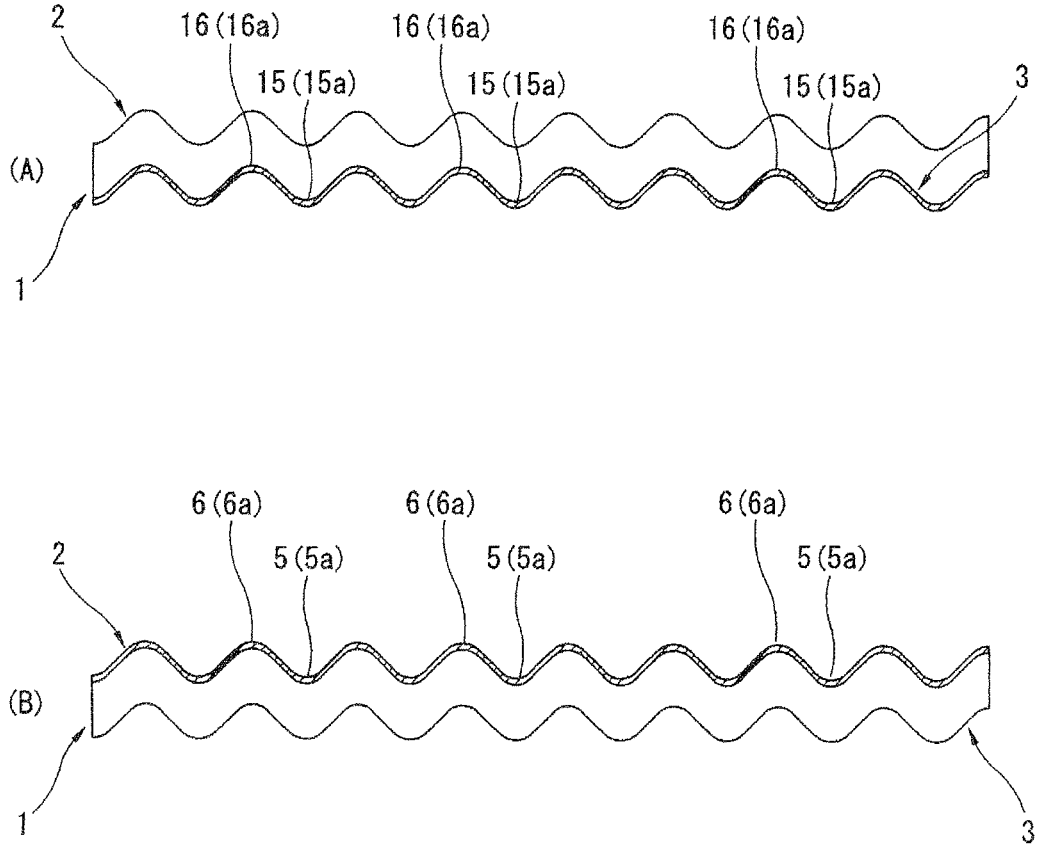
FIG. 4(A) is a sectional view taken along lines c-c of FIG. 2.
FIG. 4(B) is a sectional view taken along lines d-d of FIG. 2.

When viewing the cross-sectional shape along the longitudinal direction (X-direction) of projection row 2, as shown in FIG. 2 and FIG. 4, it is formed by bending to have a so-called corrugated cross-sectional shape of a wave shape as the shape in a cross-section along X-direction in a manner to have valley portion 5 at a position corresponding to the other diagonal line (diagonal line along Y-direction) of the tetragon shown in FIG. 5 as a unit element and crest portion 6 at a position corresponding to narrow portion 2*a*. The pitch defined between valley portion 5 and crest portion 6 and the height difference between valley portion 5 and crest portion 6 in the corrugated cross-sectional shape along X-direction are respectively smaller as compared with a relationship between projection row 2 and recess row 3 in the corrugated cross-sectional shape along Y-direction shown in FIG. 3.

The cross-sectional shape along the longitudinal direction (X-direction) of this projection row 2 also appears in recess row 3 adjacent to projection row 2. As shown in FIG. 2 and FIG. 4, recess row 3 is formed by bending to have a so-called corrugated cross-sectional shape of a wave shape as the shape in a cross-section along X-direction in a manner to have crest portion 16 at a position corresponding to the other diagonal line (diagonal line along Y-direction) of the tetragon shown in FIG. 5 as a unit element and valley portion 15 at a position corresponding to narrow portion 2*a*.

Then, as clear from FIG. 2, between projection row 2 and recess row 3 adjacent thereto, edge lines 6*a* of respective crest portions 6 on the side of projection row 2 and edge lines 16*a* of respective crest portions on the side of recess portion 3 are positioned on the same lines in Y-direction. Similarly, edge lines 5*a* of respective valley portions 5 on the side of projection row 2 and edge lines 15*a* of respective valley portions 15*a* on the side of recess row 3 are positioned on the same lines in Y-direction.

Therefore, the corrugated metal plate 1 shown in FIGS. 1 and 2 has the same corrugated cross-sectional shape like that of FIG. 4 in each of the cross-section taken along lines c-c along X-direction of recess row 3 and the cross-section taken along lines d-d along X-direction of projection row 2 of FIG. 2.

On the other hand, the corrugated metal plate 1 shown in FIGS. 1 and 2 has a corrugated cross-sectional shape like that of FIG. 3(A) in the cross-section taken along lines a-a passing through edge lines 15*a*, 5*a* of respective valley portions 15, 5 in recess row 3 and projection row 2 of FIG. 2. Although the shape shown in FIG. 3(B) is slightly different from that of 3(A), it is similarly turned into a corrugated cross-sectional shape in the cross-section taken along lines b-b passing through edge lines 16*a*, 6*a* of respective crest portions 16, 6 in projection row 3 and recess row 2.

As is clear from above, in the metal plate 1 shown in FIGS. 1 and 2, a relationship between adjacent projection row 2 and recess row 3 when viewed from the front side coincides with a relationship between adjacent recess row 3 and projection row 2 when viewed from the back side, and the shapes of projection row 2 and recess row 3 coincide with each other on the front and the back.

In other words, in case that the shape in the cross-section along Y-direction passing through edge lines 6*a*, 16*a* of crest portions 6, 16 in projection row 2 and recess row 3 is compared with a shape resulting from inverting the front and back of the shape in the cross-section along Y-direction passing through edge lines 15*a*, 5*a* of valley portions 15, 5 in recess row 3 and projection row 2, they coincide with each other in shape although projection row 2 or recess row 3 is displaced by one row in Y-direction.

Similarly, in case that the shape in the cross-section along X-direction of projection row 2 is compared with a shape resulting from inverting the shape along X-direction of recess row 3, they coincide with each other in shape although the crest portion 16, 6 or valley portion 15, 5 is displaced in X-direction by a half pitch. In other words, the corrugated metal plate 1 of the present embodiment has substantially the same projection-recess shape on the front side and the back side. Therefore, it is a so-called reversible metal plate that can be used and/or enables a product design without differentiating its front and back. Then, inclined wall surface 4 positioned between projection row 2 and recess row 3 extends in X-direction in a wave form in plan view as shown in FIG. 2 in a manner to follow both wavy sectional shapes of projection row 2 and recess row 3.

A wall surface interposed between projection row 2 and recess row 3 is turned into inclined wall surface 4. This is also effective for suppressing the occurrence of fracture (fissure or crack) of corrugated metal plate 1. One get the impression as if it appears to become advantageous in strength, for example, if one turns a wall surface interposed between projection row 2 and recess row 3 as a boundary wall shared thereby into a vertical wall and if one tries to decrease the pitch defined between those projection row 2 and recess row 3 to increase density of them. On the other hand, irrespective of being inclined wall surface 4 or being the vertical wall, fracture tends to occur by stress concentration at a raised portion of the wall surface if the wall surface is steeply raised. In view of this point, as mentioned above, the wall surface interposed between projection row 2 and recess row 3 is turned into inclined wall surface having a wave shape in plan view. Furthermore, provided that the pitch defined between projection row 2 and recess row 3 is constant, the adaptation of inclined wall surface 4 decreases the flat base plate's area and therefore becomes advantageous in terms of material cost, too, as compared with the adaptation of the vertical wall in place of inclined wall surface 4.

The corrugated metal plate 1 of such shape is formed by pressing with only a single machining, for example, by putting a flat base plate between upper and lower molds having irregularities of a predetermined pattern and then pressure clamping. Alternatively, it is formed by pressing with only a single machining similar to the above, by sending a flat base plate into a meshing section of gear-shape rotary molds formed with irregularities of a predetermined pattern.

The reason why it can be formed into a predetermined shape by a single pressing is based on that, as shown in FIGS. 3 and 4, although both of a cross-sectional shape along X-direction and a cross-sectional shape along Y-direction of the corrugated metal plate 1 have corrugated cross-sectional shapes, they do not have a shape causing a hooking relation by an undercut or inverse relation relative to a direction of withdrawal of a press tool (mold). That is, it is based on that inclined wall surface 4, which forms groove-shape spaces on the front side of recess row 3 and on the back side of projection row 2, is an inclined surface that makes the groove width on an open side of a groove-shape space greater than that on its bottom side.

Therefore, such corrugated metal plate 1 can be prepared to have a predetermined shape by only a single pressing operation as mentioned above. Thus, the press molds can have a simple structure, and the workload becomes the minimum, thereby lowering the cost.

Furthermore, as shown in FIG. 3, the cross-sectional shape even at a position of any section along Y-direction is formed into a corrugated sectional shape of a generally rectangular wave shape, and, as shown in FIG. 4, the cross-sectional shape even at a position of any section along X-direction perpendicular to Y-direction is formed into a corrugated sectional shape having a pitch and a height which are smaller than those of the sectional shape along Y-direction. Therefore, the corrugated metal plate 1 as a whole becomes high in second moment of area, and the difference between flexural rigidity in X-direction of corrugated metal plate 1 and that in Y-direction is almost eliminated, thereby making it superior in surface rigidity.

This can be explained as follows. In the case of bending the corrugated metal plate 1 along X-direction, the edge lines of crest portions 6, 16 and valley portions 5, 15 in each of projection row 2 and recess row 3 are perpendicular to X-direction. Therefore, it can show a sufficient resistance against the bending force. Furthermore, in the case of bending the corrugated metal plate 1 along Y-direction, the edge lines of crest portions 6, 16 and valley portions 5, 15 in each of projection row 2 and recess row 3 are along Y-direction. Therefore, one gets the impression as if bending tends to occur from those edge lines as starting points. However, as is clear from FIG. 2, inclined wall surface 4 of a wave shape extends in X-direction between adjacent projection row 2 and recess row 3 in a manner to break continuity of the edge lines of both crest portions 6, 16 and valley portions 5, 15. With this, it can also show a sufficient resistance against the bending force to bend it along Y-direction. These things can be true even in case that crest portions 6, 16 and valley portions 5, 15 in each of projection row 2 and recess row 3 are understood as projection portions and recess portions.

Moreover, the shape on the front side is substantially the same as that on the back side. Not only there is no need to differentiate the back side and the front side, but also flexural rigidity in X-direction and that in Y-direction are similar. Therefore, it is possible to minimize the difference between them. This means that, when using the corrugated metal plate 1 as a mechanical structure, not only there is no need to differentiate the front side and the back side, but also the directional property of X-direction and Y-direction does not matter. As a result, for example, in the case of conducting a product design of an automotive engine's heat insulation cover, etc. by using corrugated metal plate 1 as a base plate, its usability becomes extremely good.

Furthermore, it does not have an extremely bent region where blanks are stacked. Therefore, for example, even if it receives a repeated vibration force, there is no risk of the occurrence of cracks and/or fracture caused by stress concentration.

Furthermore, as mentioned above, projection row 2 and its adjacent recess row 3 share inclined wall surface 4 therebetween. Therefore, even if corrugated metal plate 1 is used in any direction, a region functioning as a liquid pool is not generated. As a result, it is possible to prevent the occurrence of secondary defects caused by accumulation of oil, rain water, etc. In particular, it also becomes a preferable one, even in the case of using it particularly as a heat insulation cover that is arranged close to an exhaust manifold as an automobile's heat generating section.

Figure 6:
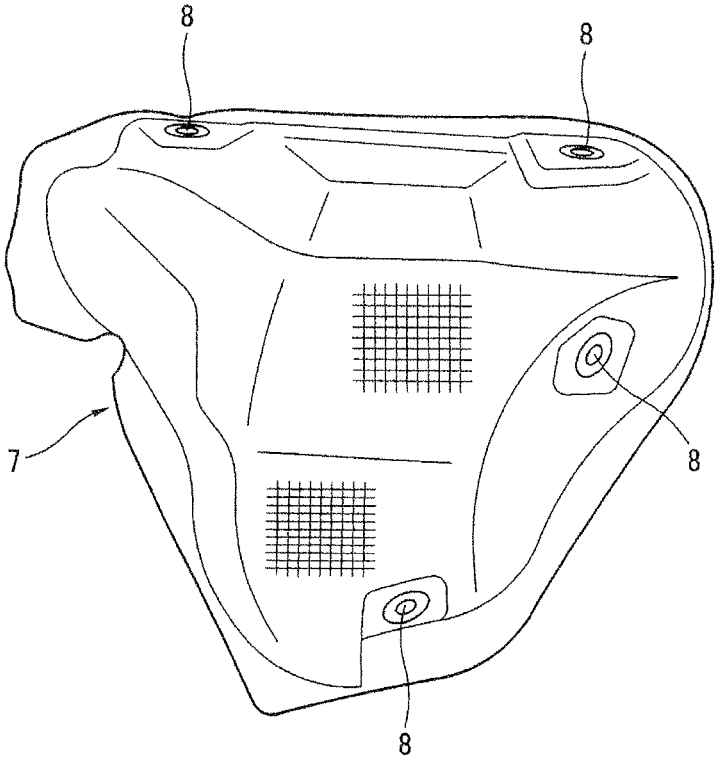
FIG. 6 is an explanatory view showing one example of a heat insulation cover formed by using the metal plate shown in FIG. 1.

FIG. 6 shows heat insulation cover 7 that is arranged close to cover an automotive engine's exhaust manifold as one example of products prepared by using the above-mentioned corrugated metal plate 1 as a base plate. This heat insulation cover 7 is formed by bending, for example, into a deep pan shape or modified cup shape to have a predetermined three-dimensional shape to be capable of surrounding the exhaust manifold. It has a hemmed peripheral edge portion and bolt attaching holes 8 with washers at several positions. In the case of using it as a heat insulation cover to cover a muffler, it is formed into a generally semicylindrical shape.

Corrugated metal plate 1 used as this heat insulation cover was prepared as mentioned above by using a flat aluminum plate having a thickness of 0.6 mm as a base plate and conducting an embossing corrugation machining thereon. The pitch defined between projection row 2 and recess row 3 shown in FIG. 3 was adjusted to around 10 mm, and the maximum height until edge line 6*a* of crest portion 6 in projection row 2 (equals to the maximum depth until edge line 5*a* of valley portion 5 in recess row 3) was adjusted to around 5 mm.

This heat insulation cover 7 was subjected to a high-temperature vibration test, a high-temperature tensile test, a heat insulation performance test, a sound vibration performance test, an electrolytic corrosion test, etc. As a result, it was confirmed to meet all of necessary performances needed in practical use.

Herein, corrugated metal plate 1 of the present embodiment is not limited to the use as a heat insulation cover for the above-exemplified exhaust manifold and other automobile's heat generating sections. For example, it can be widely used as a structural member in various industrial fields, such as architecture, home electric appliances and sports goods, as well as transport equipment such as automobiles, railways, watercrafts and aircrafts. As to its use, it can also be used as a heat exchanging material, a reinforcing material, etc. as well as various heat insulation materials, sound insulation materials, sound absorbing materials, wind insulation materials, light insulation materials, etc.

In this case, depending on use, thickness and material of a flat base plate for producing corrugated metal plate 1 are suitably selected. As material of the base plate, it is possible to use aluminum (for example, A1050), nonferrous metal plates other than aluminum one, metal plates represented by steel plate, and a composite material (cladding material) having two or three layers of a steel plate, a metal plate other than that, and a nonferrous metal. As corrugated metal plate 1 used for a vehicle-mounted, heat insulation cover, etc., aluminum or an aluminum-based material is desirable from the viewpoint of weight reduction. As to its thickness too, for example, one having a range of about 0.15-1.0 mm is desirable.

Thus, corrugated metal plate 1 of the present embodiment has a shape that can be prepared by conducting a necessary bending machining with a substantially single step. Therefore, it is possible to reduce the cost by decreasing the number of the press machinings. Furthermore, the recess portion and/or valley portion does not function as a liquid pool. Thus, it is possible to prevent the occurrence of secondary defects based on a part functioning as a liquid pool as before.

Figure 7:
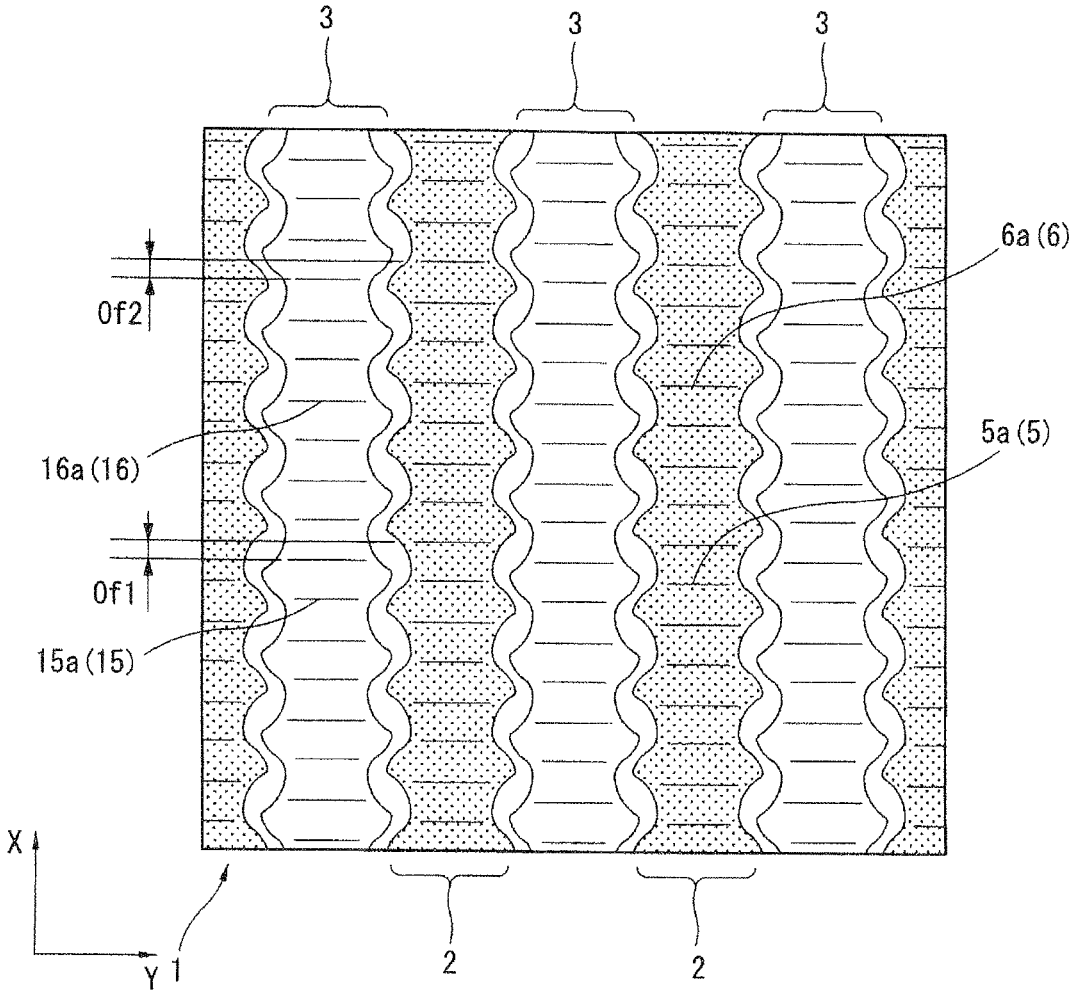
FIG. 7 is a plan view showing the second embodiment of a metal plate according to the present invention.
Figure 18:
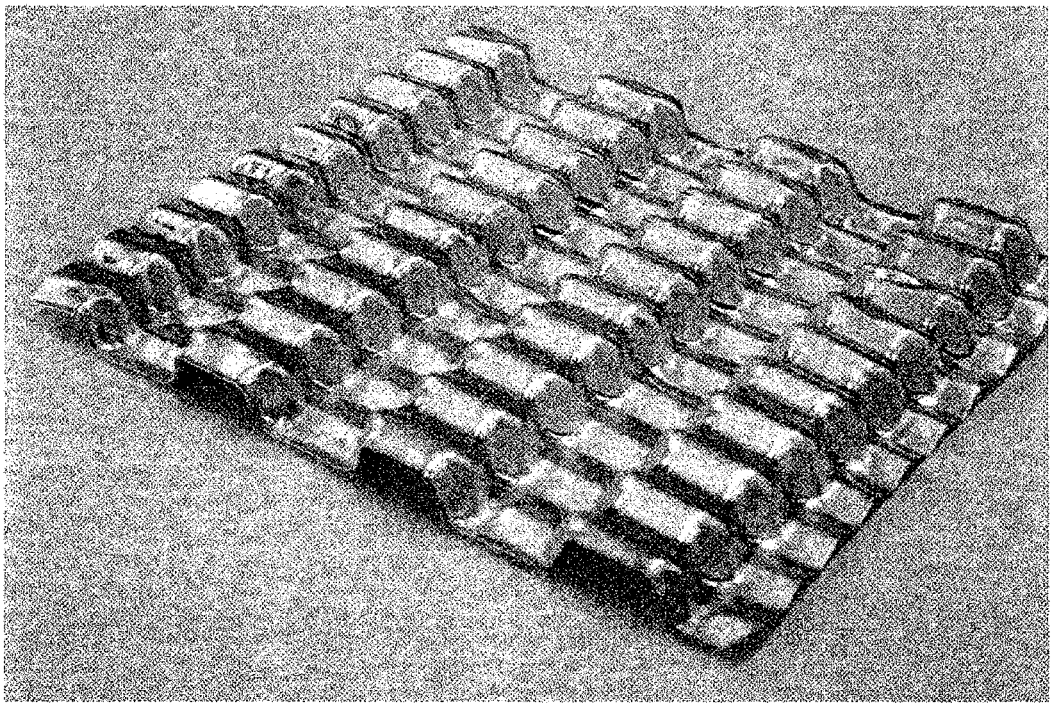
FIG. 18 is a photograph of the metal plate shown in FIG. 7.
Figure 19:
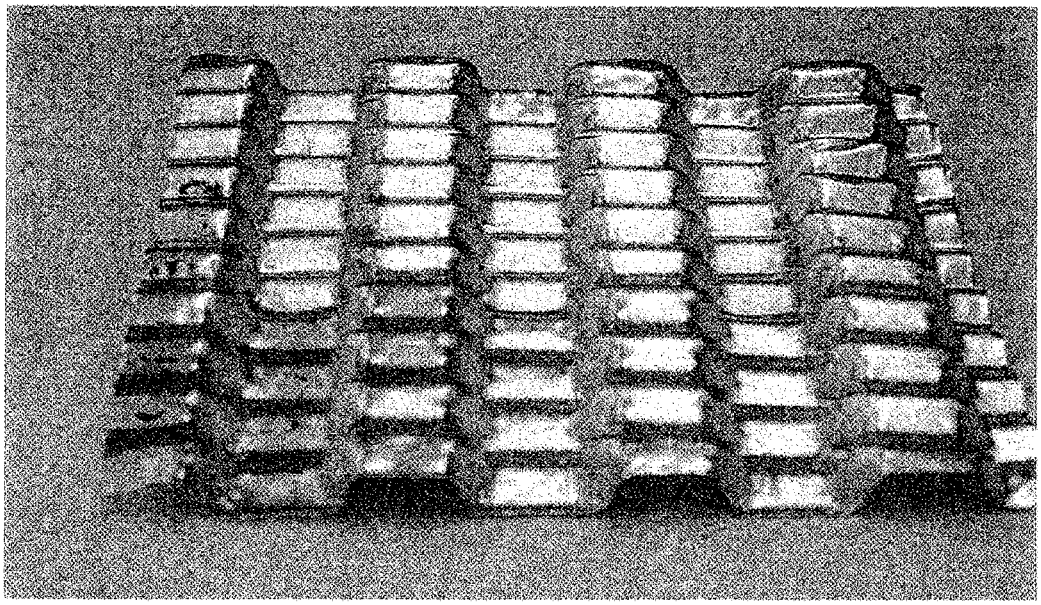
FIG. 19 is a photograph of the metal plate shown in FIG. 7.
Figure 20:
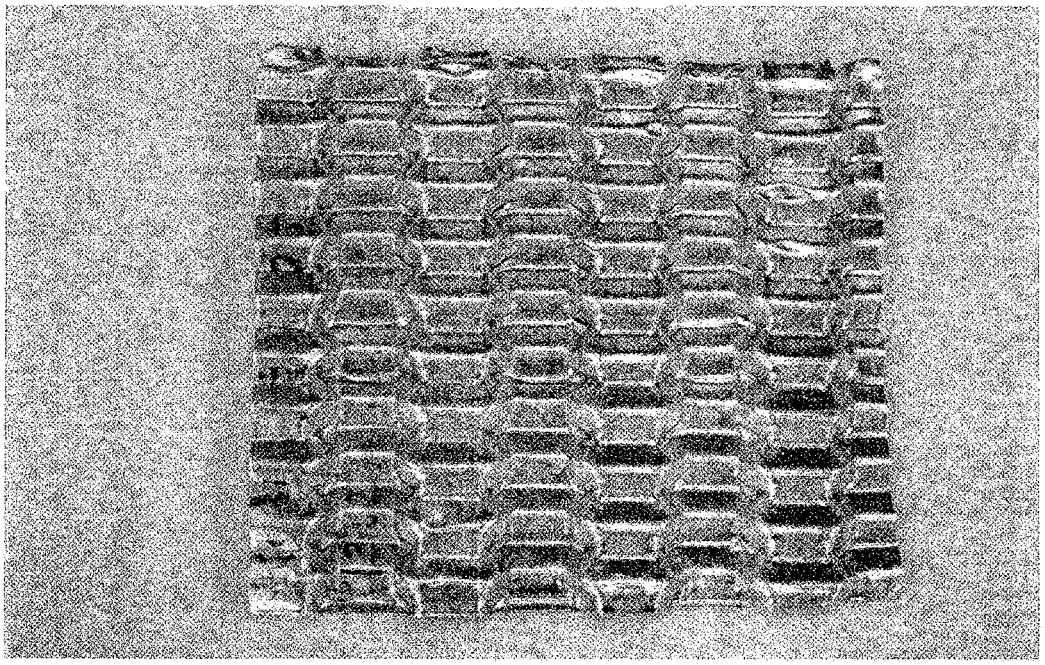
FIG. 20 is a photograph of the metal plate shown in FIG. 7.

FIG. 7 shows a plan view of corrugated metal plate 1 as the second embodiment of a metal plate according to the present invention. Parts common to the first embodiment are designated by the same signs. For an easy understanding of the corrugated metal plate shown in FIG. 7, photographs of the same metal plate are shown in FIGS. 18-20.

In this second embodiment, an embossed pattern similar to that of FIG. 2 is a prerequisite. However, as is clear from FIG. 7, between projection row 2 and its adjacent recess row 3, in order to make edge lines 6*a*, 16*a* of their crest portions 6, 16 offset in X-direction, they are slightly displaced from each other with offset amount Of1 in X-direction, and edge lines 5*a*, 15*a* of their valley portions 5, 15 are similarly displaced from each other with an offset amount Of2 in X-direction. That is, in this second embodiment, as it is distinct from FIG. 2, in order that edge lines 6*a*, 16*a* of their crest portions 6, 16 are not aligned in Y-direction, they are slightly offset in X-direction. Furthermore, in order that edge lines 5*a*, 15*a* of their valley portions 5, 15 are not aligned in Y-direction, they are slightly offset in X-direction.

According to this second embodiment, it will exhibit functions similar to those of the above first embodiment. It is possible to expect a further improvement of surface rigidity. In particular, there is an advantage that it is possible to further decrease the difference between flexural rigidity in X-direction and flexural rigidity in Y-direction (a good X-Y rigidity ratio).

Figure 8:
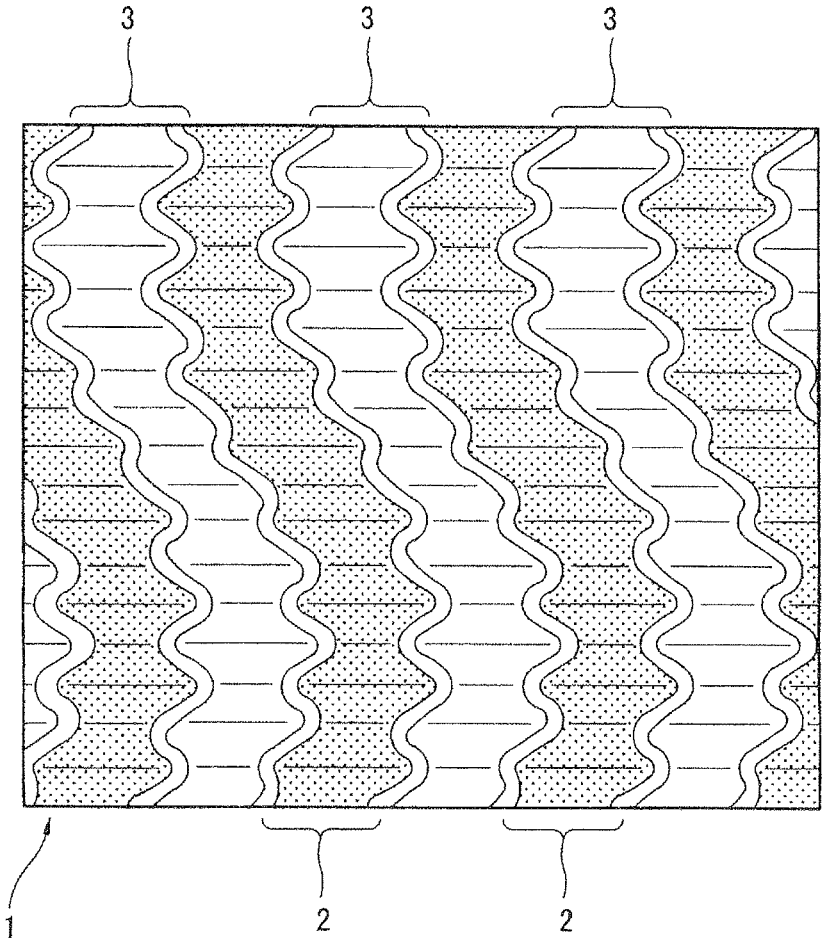
FIG. 8 is a plan view showing the third embodiment of a metal plate according to the present invention.

FIG. 8 shows a plan view of corrugated metal plate 1 as the third embodiment of a metal plate according to the present invention. Parts common to the first embodiment are designated by the same signs.

In this third embodiment, an embossed pattern similar to that of FIG. 2 is a prerequisite. The longitudinal direction of projection row 2 and its adjacent recess row 3 is deviated from X-direction, and the longitudinal axis of projection row 2 and recess row 3 is intentionally in a meandering or bent shape. It is optional to make a meandering shape based on the embossed pattern of FIG. 7. It is preferable to make a meandering shape in a manner to secure rigidity of a three-dimensional product shape and an easy forming.

This third embodiment also makes it possible to obtain advantageous effects similar to those of the first embodiment.

Figure 9:
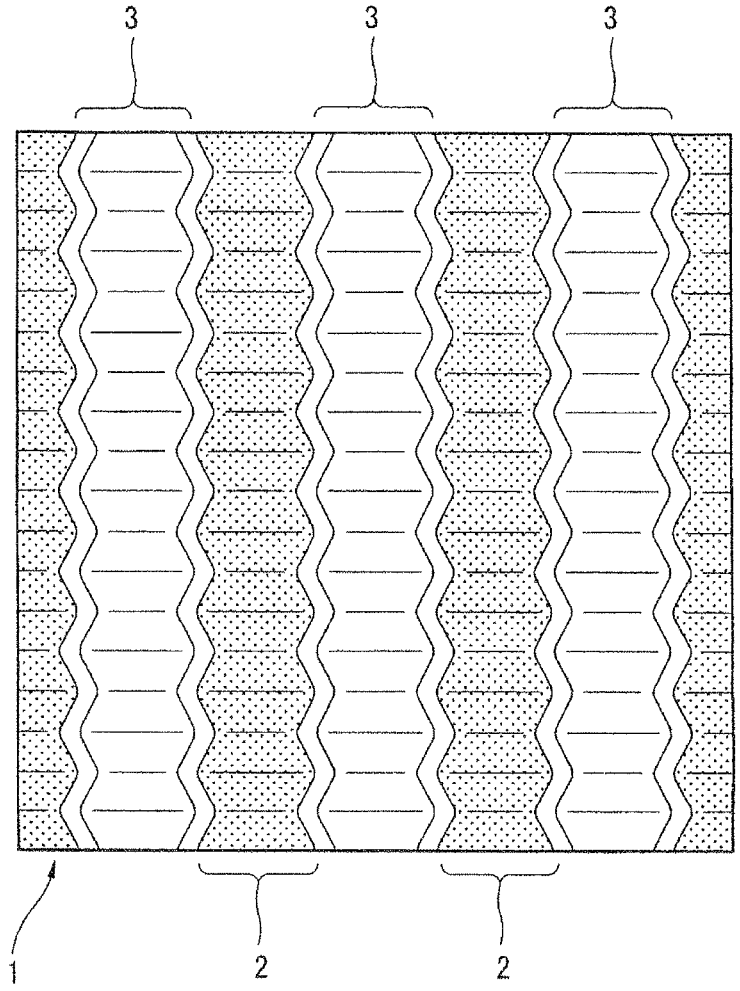
FIG. 9 is a plan view showing the fourth embodiment of a metal plate according to the present invention.
Figure 10:
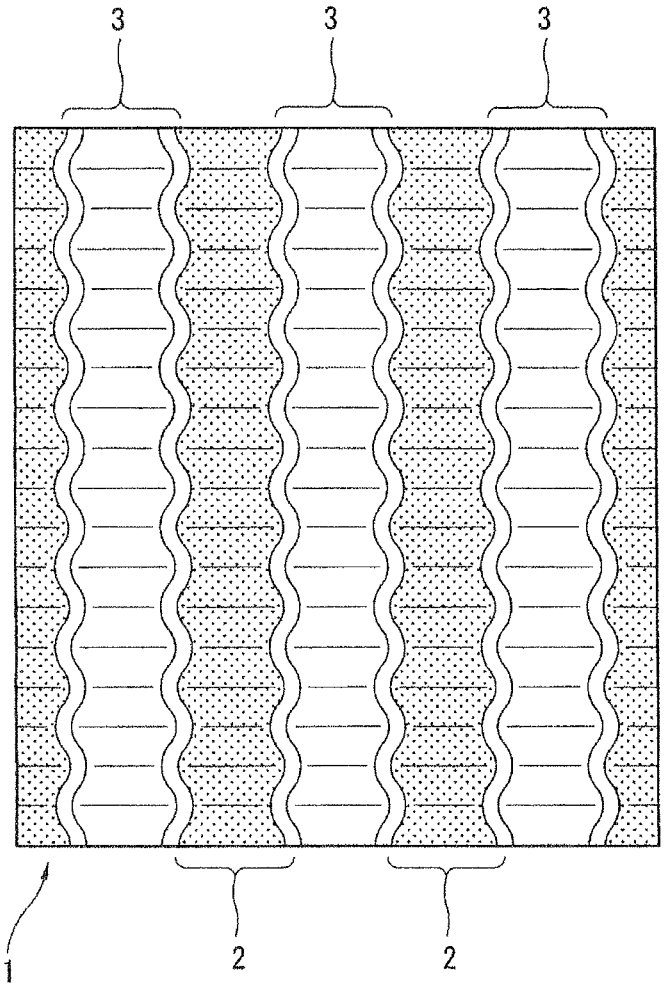
FIG. 10 is a plan view showing the fifth embodiment of a metal plate according to the present invention.
Figure 11:
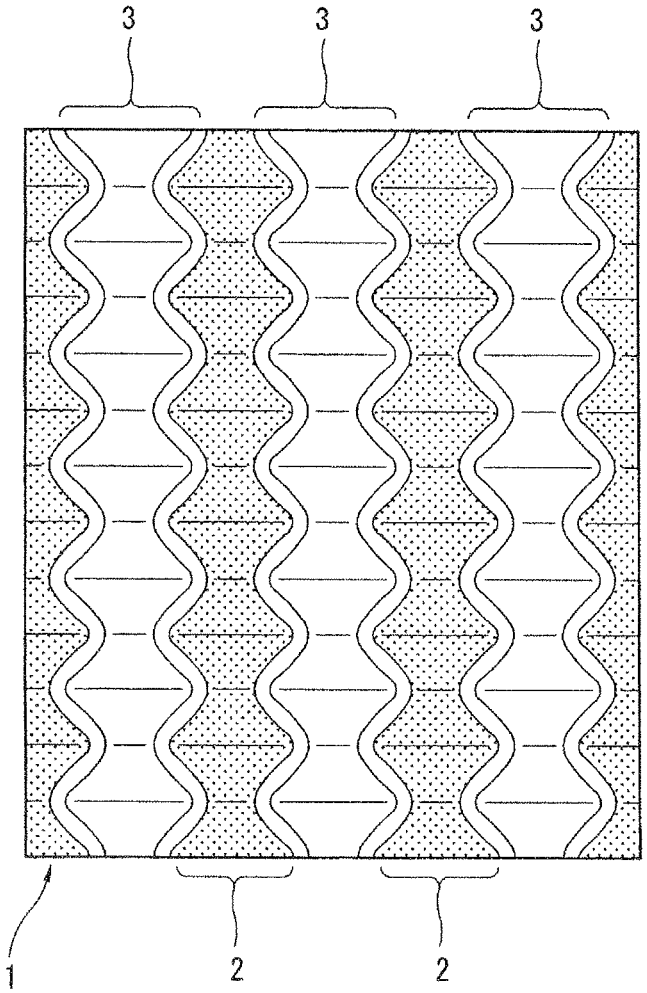
FIG. 11 is a plan view showing the sixth embodiment of a metal plate according to the present invention.

FIG. 9 to FIG. 11 show plan views of corrugated metal plate 1 as the fourth to seventh embodiments of a metal plate according to the present invention, and parts common to the first embodiment are designated by the same signs.

In the fourth embodiment shown in FIG. 9, as is clear from a comparison with FIG. 2, projection row 2 and recess row 3 are decreased in width in plan view as compared with those of FIG. 2, and the wave shape at both sides of projection row 2 and recess row 3 is decreased in elevation difference and is sharpened. Furthermore, in the fifth embodiment shown in FIG. 10, the wave shape at both sides of projection row 2 and recess row 3 is decreased in elevation difference and on the contrary is turned into a smoother shape.

Figure 12:
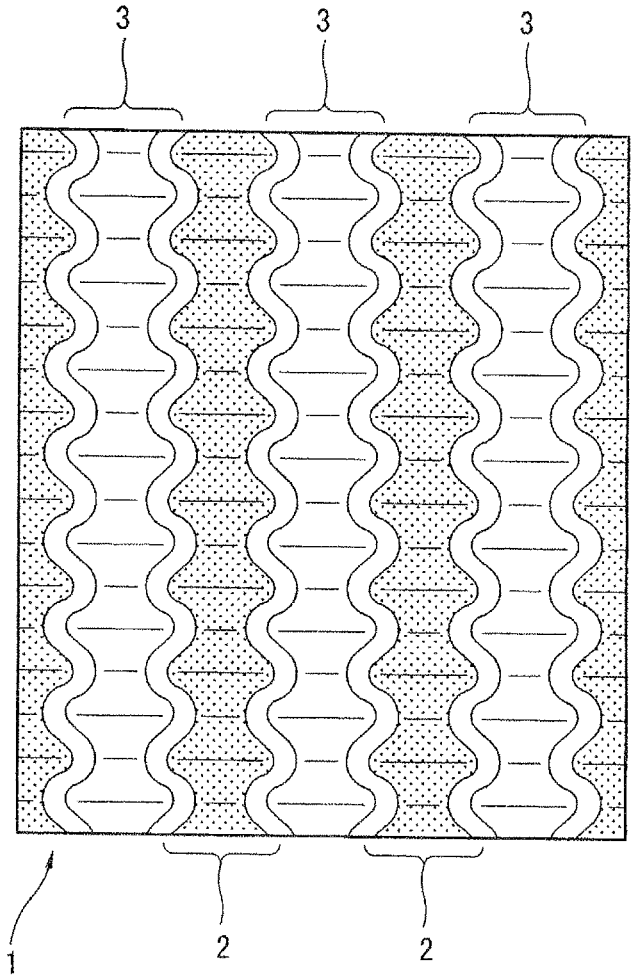
FIG. 12 is a plan view showing the seventh embodiment of a metal plate according to the present invention.
Figure 13:
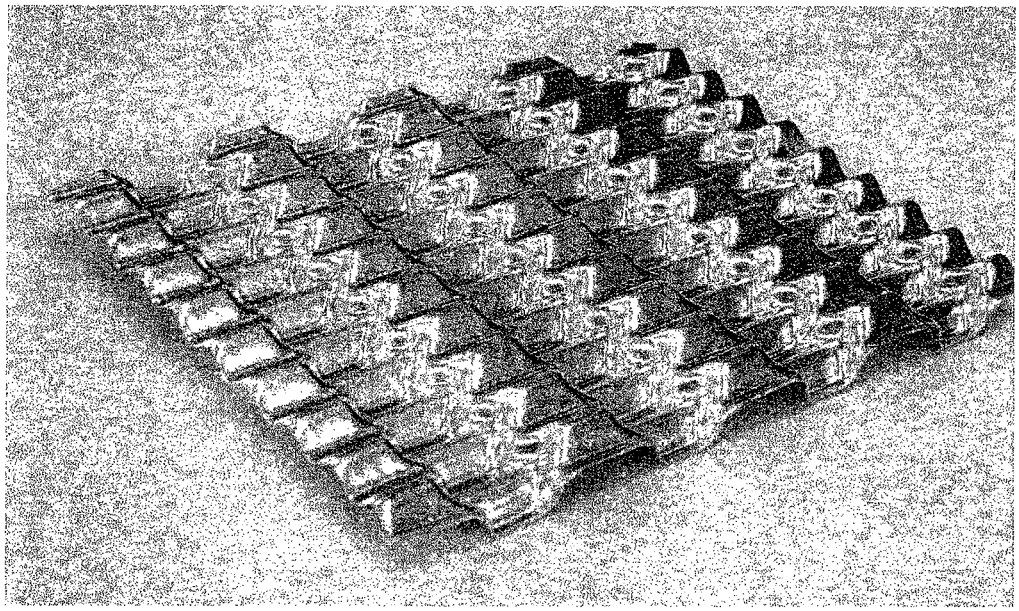
FIG. 13 is a photograph of the metal plate shown in FIG. 1.
Figure 14:
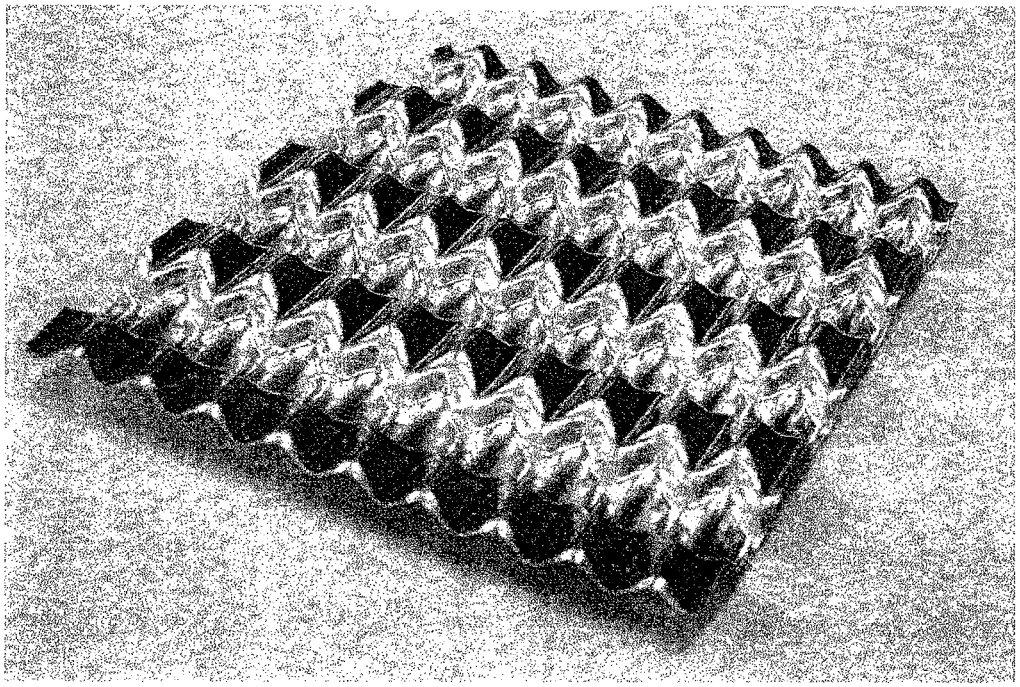
FIG. 14 is a photograph of the metal plate shown in FIG. 1.
Figure 15:
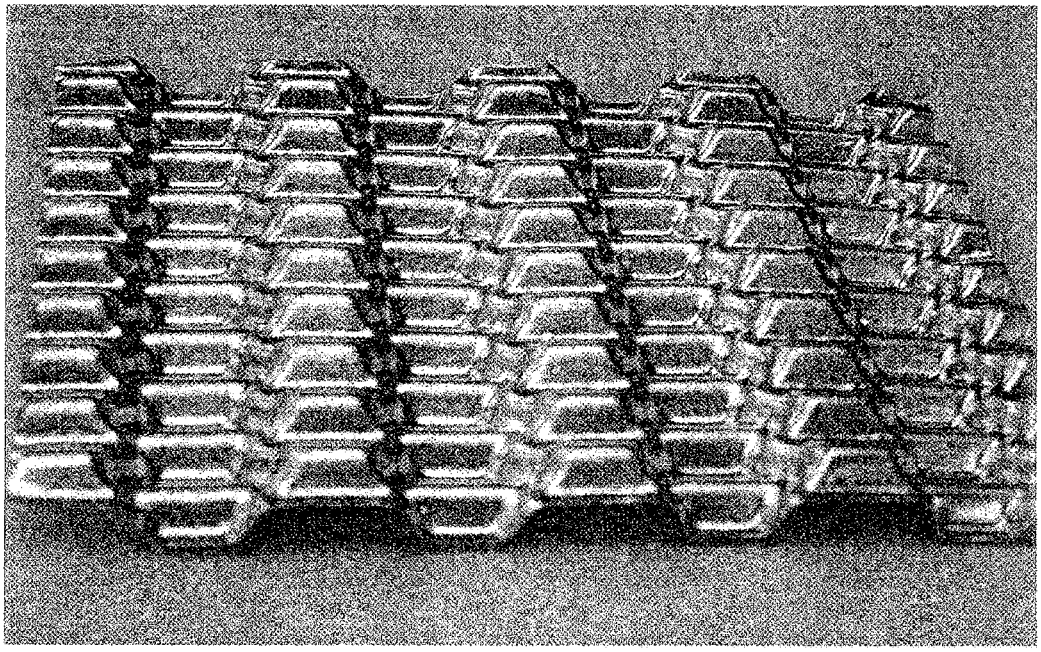
FIG. 15 is a photograph of the metal plate shown in FIG. 1.
Figure 16:
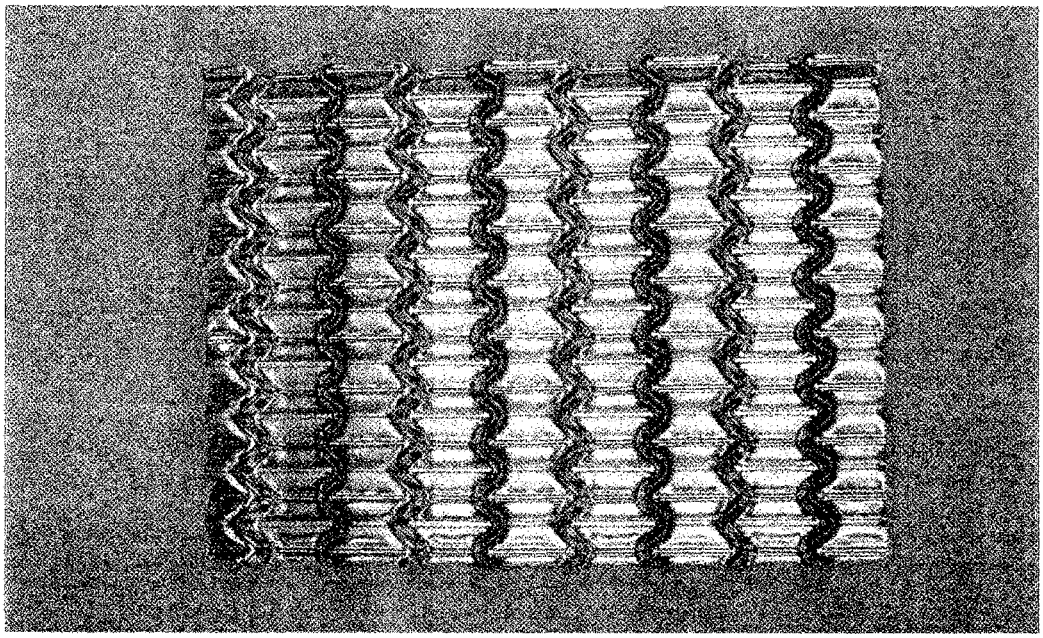
FIG. 16 is a photograph of the metal plate shown in FIG. 1.
Figure 17:
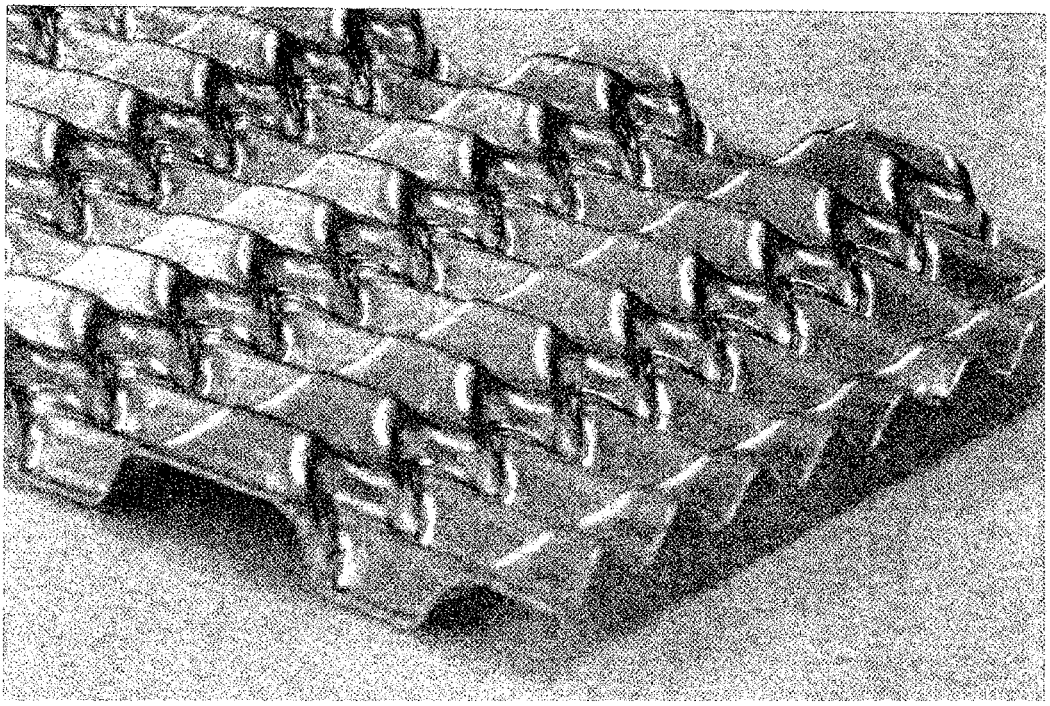
FIG. 17 is a photograph of the metal plate shown in FIG. 1.

In the sixth embodiment shown in FIG. 11, as is clear from a comparison with FIG. 2, the pitch defined between valley portion 5 and crest portion 6 in projection row 2 and the pitch defined between valley portion 15 and crest portion 16 in recess row 3 are respectively larger as compared with those of FIG. 2. Furthermore, in the seventh embodiment shown in FIG. 12, as is clear from a comparison with FIG. 2, the pitch defined between projection row 2 and recess row 3 is smaller as compared with that of FIG. 2, and projection row 2 and recess row 3 are smaller in width in plan view as compared with those of FIG. 2.

In the fourth to seventh embodiments shown in FIG. 9 to FIG. 11, as is clear from a comparison with FIG. 2, the embossed patters of projection row 2 and recess row 3 are respectively slightly different. However, both of projection row 2 and recess row 3 as planar shapes along Y-direction are in a shape in which tetragon in plan view is defined as a unit element (cell) and in which a plurality of tetragons are in succession while they are overlapped with each other by a predetermined amount at their respective corner portions in one diagonal line matching with Y-direction. This is common to that shown in FIG. 5.

Therefore, the fourth to seventh embodiments shown in FIG. 9 to FIG. 11 also show advantageous effects under functions similar to those of the first embodiment.

The invention claimed is:

1. A metal plate comprising an upper surface, a side wall surface, a lower surface and a side wall surface in this order in succession to form a row having a shape of a projection and a recess, wherein each side wall is provided such that a width between the two upper surfaces positioned to interpose the lower surface is wider than a width of the lower surface, wherein the upper surface is formed into a wave shape in a first cross-section along a direction of a row of the upper surface, the first cross-section being perpendicular to a second cross-section containing a direction of the row having the shape of the projection and the recess and a direction of the row of the upper surface and the lower surface, wherein the lower surface is formed into a wave shape in a third cross-section along a direction of a row of the lower surface, the third cross-section being perpendicular to the second cross-section, and wherein each side wall surface is formed into a wave shape in plan view such that an edge of the upper surface and an edge of the lower surface, where each side wall surface is interposed therebetween, are each formed into a wave shape that conforms to the wave shape of each side wall surface.

2. The metal plate as claimed in claim 1, wherein each side wall is an inclined surface.

3. The metal plate as claimed in claim 2, wherein the upper surface has a crest portion and a valley portion and has a wave shape in the first cross-section along the direction of the row of the upper surface, and the lower surface has a crest portion and a valley portion and has a wave shape in the third cross-section along the direction of the row, the crest portion and the valley portion being alternately formed in succession in the direction of the row, having a pitch defined therebetween that is smaller than a pitch defined between the upper surface and the lower surface, and having a height difference therebetween that is smaller than a height difference between the upper surface and the lower surface.

4. The metal plate as claimed in claim 3, wherein, between the upper surface and the lower surface that are adjacent to each other with an interposal of the side wall surface, an edge line of the crest portion of the upper surface and an edge line of the crest portion of the lower surface are aligned with each other, and an edge line of the valley portion of the upper surface and an edge line of the valley portion of the lower surface are aligned with each other.

5. The metal plate as claimed in claim 4, wherein a shape in the cross-section of the row of the upper surface and a shape in the third cross-section of the row of the lower surface are identical.

6. The metal plate as claimed in claim 5, wherein a shape in a cross-section passing through crest portions of the upper surface and the lower surface coincides with a shape prepared by inverting upside down a shape in a cross-section passing through valley portions of the upper surface and the lower surface.

7. The metal plate as claimed in claim 3, wherein, between the upper surface and the lower surface that are adjacent to each other with an interposal of the side wall surface, an edge line of the crest portion of the upper surface and an edge line of the crest portion of the lower surface are displaced from each other in a direction of the row, and an edge line of the valley portion of the upper surface and an edge line of the valley portion of the lower surface are displaced from each other in a direction of the row.

8. A metal cover that is formed and bent into a three-dimensional shape by using the metal plate as claimed in claim 1 as a base plate.

* * * * *